United States Patent [19]

Peveto et al.

[11] 4,170,908

[45] Oct. 16, 1979

[54] INDEXING MECHANISM FOR AN OPEN-HEAD POWER TONG

[75] Inventors: John E. Peveto; Gregory D. Cathcart, both of Houston, Tex.

[73] Assignee: Joy Manufacturing Company, Pittsburgh, Pa.

[21] Appl. No.: 901,670

[22] Filed: May 1, 1978

[51] Int. Cl.[2] ..... B25B 17/00

[52] U.S. Cl. ..... 81/57.11; 81/57.18; 81/57.2; 81/57.34

[58] Field of Search ..... 81/57.11, 57.12, 57.13, 81/57.14, 57.15, 57.16, 57.18, 57.20, 57.21, 57.33, 57.34

[56] References Cited

U.S. PATENT DOCUMENTS

| | | | |
|---|---|---|---|
| 2,618,468 | 11/1952 | Lundeen | 81/57.18 |
| 2,780,950 | 2/1957 | Province | 81/57.18 |
| 3,180,186 | 4/1965 | Catland | 81/57.18 |
| 3,261,241 | 7/1966 | Catland | 81/57.18 |
| 4,005,621 | 2/1977 | Turner et al. | 81/57.2 |
| 4,060,014 | 11/1977 | Turner | 81/57.2 |

*Primary Examiner*—James L. Jones, Jr.
*Attorney, Agent, or Firm*—Michael R. Swartz

[57] ABSTRACT

An open-head power tong having a bifurcated frame defining a central opening and a side opening, a rotatably supported ring having a side opening and which carries releasable pipe engaging jaws that move into and out of the central opening, and a reversible hydraulic motor for driving the ring and the jaws therewith to respectively engage and rotate a pipe in a clockwise and a counterclockwise direction during respective make-up and break-out of a drill string, is provided with a pneumatically operated indexing mechanism which automatically aligns the side openings of the frame and the ring after the termination of a make-up or break-out operation such that a drill pipe, located within the central opening, is permitted to be passed laterally therethrough so as to allow the removal of the tong from the drill string.

4 Claims, 4 Drawing Figures

INDEXING MECHANISM FOR AN OPEN-HEAD POWER TONG

BACKGROUND OF THE INVENTION

1. Field of the Invention

The present invention relates to open-head power tongs used in drilling operations, and more particularly, is directed to an improved indexing mechanism for aligning the side opening of the frame with the side opening of the pipe engaging jaw mechanism to thereby facilitate removal of the tong from a drill string.

2. Description of the Prior Art

In drilling operations, several drill pipes are threadably connected together in a make-up operation to form a drill string, whereas, during a break-out operation, the pipes are disconnected from one another. In either making-up or breaking-out of a drill string, the general practice is to hold the lower pipe while the upper pipe is rotated. There are several different types of equipment on the market for performing each of these functions, one such device commonly used for rotating the upper pipe is an open-head power tong, such as the one shown and described in U.S. Pat. No. 4,060,014, whereas, another common piece of equipment used for holding the lower pipe is a back-up tong such as the one shown and described in U.S. Pat. No. 4,005,621.

The open-head power tong basically includes a bifurcated frame that defines a drill pipe receiving central opening and a side opening that communicates with the central opening for permitting a drill pipe to laterally pass therethrough. Housed within the frame is a rotatably supported pipe engaging and gripping mechanism that generally includes a ring or rotor having a side opening and which carries a plurality of jaws that move into and out of the central opening of the frame to thereby grip a pipe and rotate the same as the mechanism is driven in either a clockwise or counterclockwise direction during respective make-up and break-out operations.

After either a make-up or break-out operation has been terminated, generally the jaws of the engaging mechanism are still engaged on the pipe and normally the side opening of the rotor is not in alignment with the side opening in the frame; and therefore, before the tong can be removed from the drill string, the jaws first must be disengaged and the side openings aligned. To disengage the jaws and align the openings, it is necessary to rotate the engaging and gripping mechanism in a direction opposite to that of what it has been previously driven. Generally, this is accomplished by an operator changing the direction of the flow of fluid to the hydraulic motor and then normally squeezing the throttle valve to slowly rotate the engaging mechanism so as to achieve a proper alignment of the openings. This is a very time consuming task, especially with those tongs that produce high torques.

There has been different approaches to facilitate this alignment problem; however, each has its disadvantages. One such approach involves a complexed mechanical linkage arrangement so interconnected to the hydraulic drive motor to stop the flow of fluid to the motor, and thus, stoppage of the motor when a cam, prepositioned on the rotor, engages a portion of the linkage. With such an arrangement the operator must first change the rotational direction of the motor and then squeeze the throttle to start the rotation. Besides, not being fully automatic, such approach involves a complex linkage, and furthermore, does not work satisfactorily on all tongs, expecially those larger tongs that create high torque outputs.

A second approach to the alignment problem is shown in U.S. Pat. Nos. 3,261,241 and 3,180,186 wherein the alignment mechanism basically includes a sophisticated and expensive hydraulic circuit having various hydraulic components so interconnected and related to the hydraulic drive motor to actuate the motor in a reverse direction and stop the same upon engagement with a prepositioned cam on the rotor so as to properly align the side openings. Such second approach does not function completely automatically and furthermore, is expensive, yet alone being difficult to maintain and repair.

SUMMARY OF THE INVENTION

In accordance with the principle objectives of the present invention, an improved indexing mechanism has been provided for an open-head power tong which overcomes the aforementioned problems and disadvantages of the prior art indexing mechanism and which is simple and inexpensive in structure, reliable in operation, easily maintained and repaired, and which is fully automatic, thereby saving time and money in the drilling operation.

In furtherance thereof, the present invention sets forth in an open-head power tong including a frame having a central opening and a throat leading to the central opening from outside the frame, a rotatable ring having a side opening and which carries jaws that move into and out of the central opening for gripping and rotating a pipe disposed therewithin upon rotation of the ring, and power means operably associated with the ring for rotating the ring and the jaws therewith during a make-up and break-out operation, an improved indexing mechanism that automatically aligns the side opening of the ring with the throat of the frame, after a make-up or break-out operation has been terminated, so as to permit a drill pipe to be passed laterally therethrough for removing the tong from a drill string.

More particularly, the improved indexing mechanism includes a moveable pneumatic index valve having a plunger which is engageable with a prepositioned cam located on the ring, a pneumatic assist cylinder operably associated with the power means for controlling the rotational direction of the ring, a pneumatic direction valve settable in one of two states for directing pneumatic pressure to the assist cylinder, a source of penumatic pressure, and a switch actuatable to communicate the pneumatic pressure from the source to the index valve causing the index valve to move to a position wherein the pressure is communicated through the direction valve and to the assist cylinder, thereby causing the power means to rotate the ring in a direction opposite to which it has been previously rotated so as to disengage the jaws from the drill pipe and stop the ring in a predetermined position wherein the side opening of the ring is properly aligned with the throat of the frame so as to permit the tong to be removed from the drill string. Specifically, the rotation of the ring in its opposite direction is stopped upon the prepositioned cam engaging the plunger of the index valve, causing the latter to move to a position wherein the pressure on the assist cylinder is relieved, thereby causing the power means to cease operation.

The invention further includes means for overriding the indexing operation so as to disengage the jaws from a pipe under conditions wherein, at the termination of a previous make-up or break-out operation, the side opening of the ring is aligned with the throat of the frame, but the jaws are still engaged on the pipe and thus, the index valve plunger is engaged with the cam on the ring so as to prevent actuation of the switch to allow the flow of pneumatic pressure to the assist cylinder for rotation of the ring. The override includes a second switch that provides for the flow of penumatic pressure from the source to the assist cylinder through the direction valve which has been preset in its second state, thereby causing the power means to rotate the ring in a direction opposite from which it has previously been rotated to thereby move the cam from engagement with the index valve, whereupon the first switch can be actuated such that the indexing operation of providing proper alignment may be performed.

The invention further includes means for automatically presetting the direction valve in one or the other of its two states when a pneumatically powered back-up tong is utilized to hold the lower pipe as the upper pipe is rotated by the rotary tong. Basically, this includes interconnecting the back-up cylinder between the source of pneumatic pressure and the direction valve such that when the back-up cylinder is actuated between its make-up and break-out positions, the direction valve is set in a corresponding state.

The foregoing and other objects, features and advantages of the invention will appear more fully hereinafter from a reading of the detailed description which follows, in conjunction with, the accompnaying sheets of drawings wherein a principle embodiment of the invention is illustrated by way of example. It is to be expressly understood, however, that the drawings are for illustrative purposes and are not to be construed in defining the limits of the invention.

BRIEF DESCRIPTION OF THE DRAWINGS

In the course of the following detailed description, reference will be frequently made to the attached drawings, in which.

DETAILED DESCRIPTION OF THE INVENTION

Figure 1:
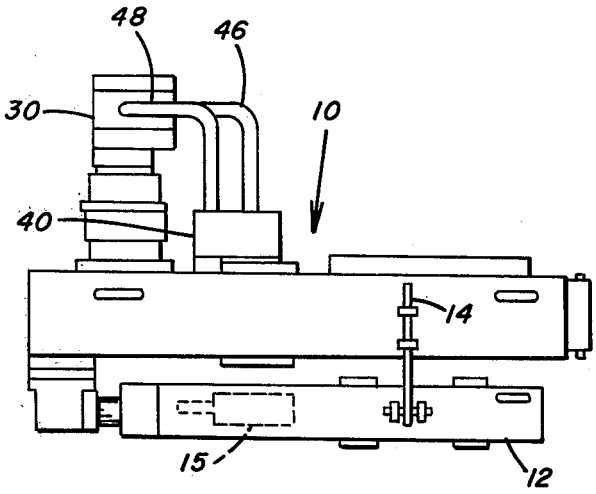
FIG. 1 is a diagramatic illustration of an open-head power tong in association with a back-up tong, which incorporates the improved indexing mechanism of the present invention.

Referring now to the drawings and particularly to FIG. 1, there is shown, for illustration purposes, an apparatus commonly used for making-up and breaking-out a drill string which includes an open-head power tong, being indicated generally by the numeral 10, and a back-up tong 12 that is disposed below and carried by the tong 10. The back-up tong 12 is supported on one end by a projection that extends downwardly from a respective end of the tong 10 with its other end being attached to the pipe receiving end of the tong 10 by a pair of fasteners 14, only one of which is shown, disposed on each side of the tong. As is well known, the back-up tong 12 is used in make-up and break-out operations to hold a lower pipe while the upper pipe is rotated such as by the power tong 10, to threadably connect or disconnect a drill string. Briefly, the back-up tong 12 comprises an elongated frame that houses a jaw clamping mechanism (not shown) that is actuated to one position for a make-up operation and to another position for a break-out operation by a suitable power source, such as the pneumatic cylinder 15. A further description of the back-up tong 12 will not follow, in that, it forms no part of the present invention other than for the purposes that will be readily apparent from the following description. For a detailed understanding of the back-up tong, reference should be made to U.S. Pat. No. 4,055,621.

Figure 3:
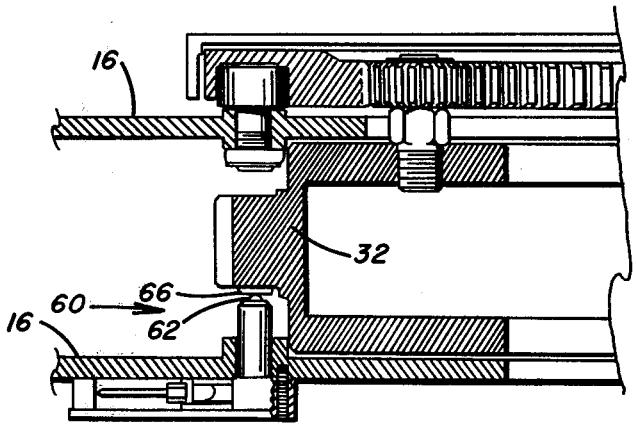
FIG. 3 is a partial sectional view of the ring showing the cam in engagement with the index valve.
Figure 2:
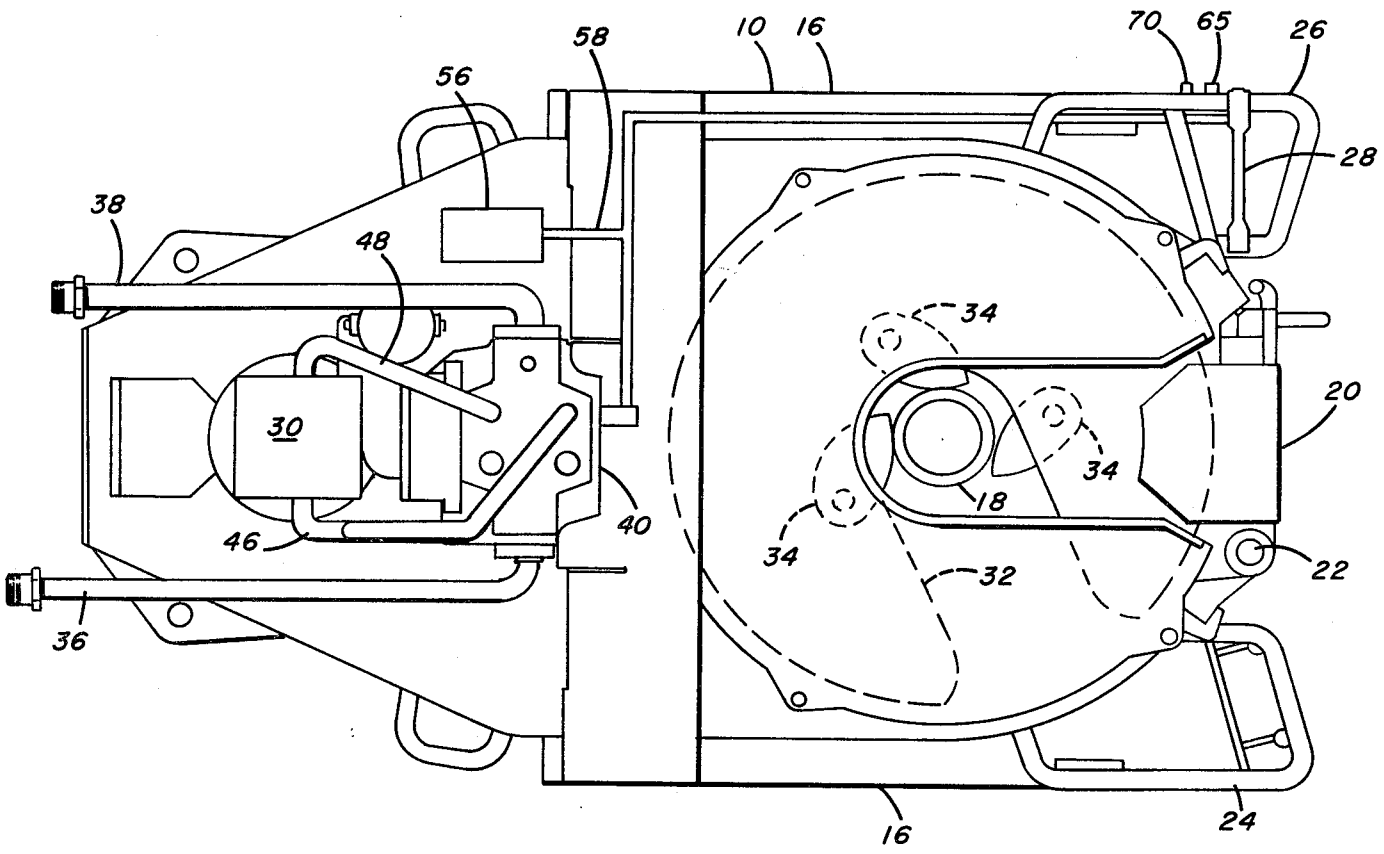
FIG. 2 is a top plan view of the open-head power tong shown in FIG. 1 with the ring of the pipe gripping mechanism so positioned that the side opening thereof is in nonalignment with the open throat of the frame and the jaws are engaged with a drill pipe such as is a common occurrence after the termination of a make-up operation.

The power tong 10, as best seen in FIGS. 2 and 3, is of the type shown and described in detail in U.S. Pat. No. 4,060,014, however, briefly, the tong 10 generally includes a bifurcated frame structure 16 that defines a central pipe receiving opening and a throat or side opening leading to the outside of the frame for permitting a drill pipe, such as pipe 18, to pass laterally therethrough to the central opening. Bridging the throat or side opening of the frame is a door 20 hinged by a pivot pin 22 mounted to one of the bifurcated ends and releasably latched to the other bifurcated end so as to span the gap between the bifurcations. Mounted on the side of each bifurcation are handles 24 and 26 that provide an operator with means for manually maneuvering the tong to its proper position. The handle 26 also serves as a convenient location for placing the throttle lever 28 for regulating the speed of the hydraulic motor 30 that rotatably drives, through a suitable drive train (not shown) the pipe gripping mechanism that grips a pipe and rotates the same upon operation of the motor. Generally, the pipe gripping mechanism includes a ring or rotor 32, rotatably supported within the frame structure 16, and which carries a plurality of engaging jaws 34 that are adapted to move into and out of the central opening for gripping a pipe and rotating the same upon rotation of the ring 32. The ring 32 is also provided with a side opening.

Figure 4:
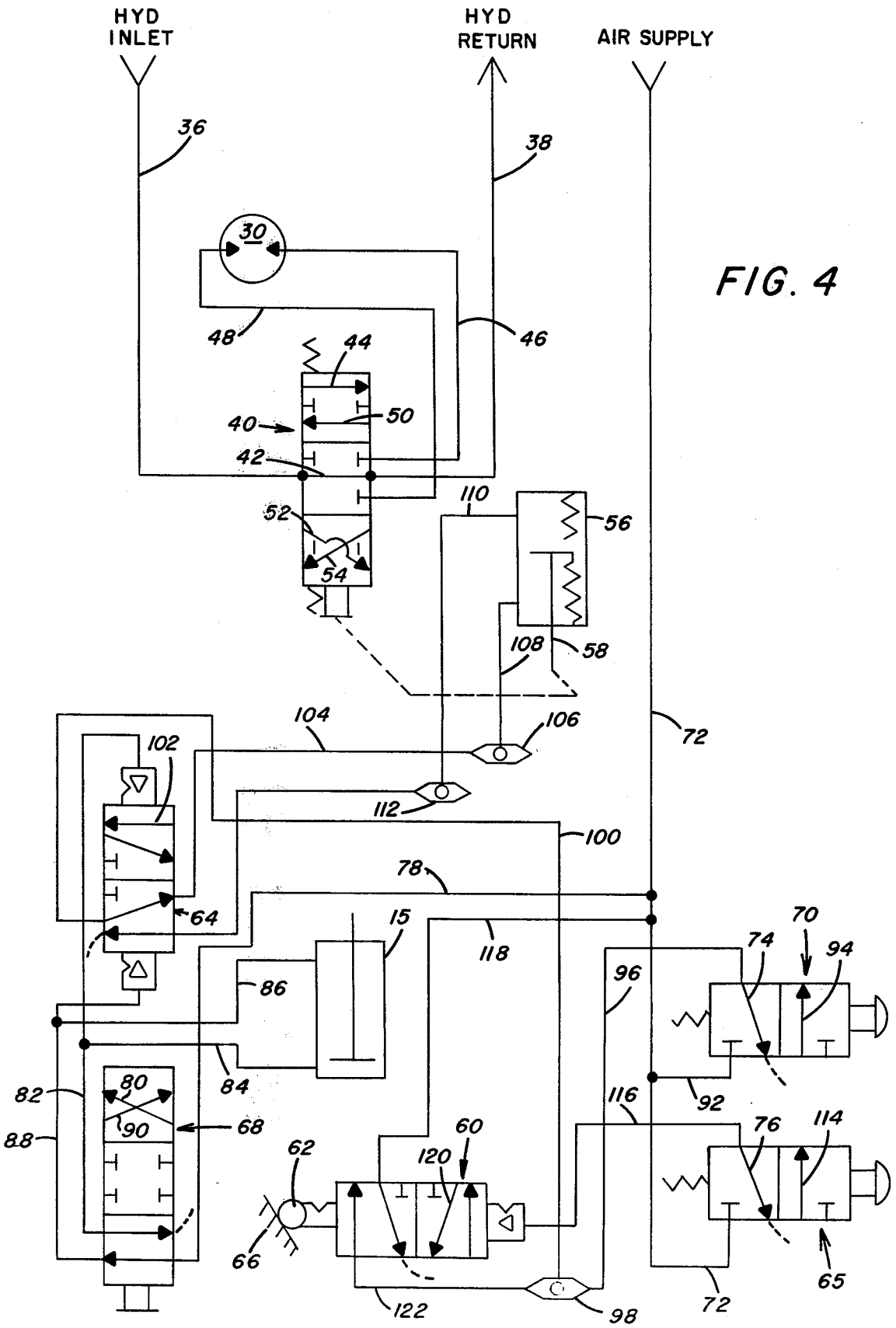
FIG. 4 is a schematic representation of the hydraulic and pneumatic circuitry and their associated components.

Also seen in FIG. 1 are respective hydraulic inlet and return lines 36, 38 connected to the hydraulic spool valve 40 for supplying fluid under pressure thereto from a suitable source (not shown), the fluid is returned to a recirculation reservoir (not shown). The valve 40 is conventional having three spool positions wherein the middle position will be referred to as the neutral position allowing hydraulic fluid to pass directly through the valve; a forward position whereby fluid is directed to one side of the motor 30, causing it to rotate in a clockwise direction such as during a make-up operation; and a reverse position whereby fluid is fed into the other side of the motor 30, causing it to rotate in a counterclockwise direction such as during a break-out operation. As seen in FIG. 4, when the spool valve 40 is in its neutral position, hydraulic fluid from the inlet line 36, passes through passageway 42 and to the return line 38; when the spool valve 40 is in its forward position, the fluid flow is via line 36, passageway 44, line 46 to the right side of motor 30, and then via line 48 to passageway 50 of spool valve 40 which is internally ported to return line 38; and when the spool valve 40 is in its reverse position, fluid flows via line 36, passageway 52, line 48 to the left side of the motor 30, and then via line 46 to passageway 54 which is also internally ported to the return line 38.

The spool valve 40 is moveable to each of its three positions through the actuation of a pneumatic assist cylinder 56. In the sake of simplicity, the assist cylinder 56 has been shown diagramatically in FIG. 1 with the mechanical linkage connecting the piston rod end 58 of cylinder 56 to the end of the spool valve 40. Thus, it should suffice to say that the spool valve 40 is moved between its three positions in response to movement of the piston rod end 58 upon actuation and retraction of assist cylinder 56.

As mentioned earlier, at the termination of either a make-up or break-out operation, generally, the jaws 34 are still in engagement with the pipe 18 and the side opening of the ring 32 is not aligned with the throat of the frame 16, thus preventing removal of the tong 10 from a drill string. To make the necessary alignment and disengage the jaws, the ring 32 must be rotated in a direction opposite to that of which is was previously rotated, and thus the motor 30 must be driven in a reverse direction. This is accomplished automatically by the improved indexing mechanism provided by the present invention which will hereinafter be described in detail.

The improved indexing mechanism preferably includes a pneumatically piloted index valve 60 having a plunger 62 moveable between engaged and disengaged positions, a pneumatically piloted direction valve 64 settable between two separate flow states, the pneumatic assist cylinder 56 (which was discussed earlier), a suitable source of pneumatic pressure, such as an air compressor (not shown), an index actuating switch 65 for communicating pneumatic pressure from the source to the index valve 60, and a cam 66 on the ring 32 for engagement and disengagement with the plunger 62 of index valve 60 (see FIG. 3). The cam 66 is positioned on the ring 32, relative to the side opening of the ring, so as to engage the plunger 62 when the side opening of the ring 32 is aligned with the throat of the frame 16. The direction valve 64 (not shown in FIGS. 1–3) is a double dented so as to be set in one or the other of its flow states.

For automatically presetting the direction valve 64, the cylinder 15 of the back-up 12 with its positioning valve 68 has been interconnected thereto such that actuation of the cylinder sets the direction valve 64 in one state and that retraction of the cylinder 15 sets the direction valve 64 in its other state. A further description of the presetting operation will be given later on in this specification.

The improved indexing mechanism further includes an override switch 70, operably interconnected with the other components of the indexing mechanism, to override the operation of the index valve 60 under conditions wherein, at the termination of either a make-up or break-out operation, the side opening of the ring 32 is in alignment with the throat of the frame 16, but the jaws 34 are still engaged with the drill pipe 18. In such condition, the plunger 62 of the index valve 60 is in engagement with the cam 66 of ring 32, thus preventing the normal operation of the indexing function so as to rotate the ring 32 and the jaws 34 therewith in an opposite direction whereby the jaws 14 disengage from the pipe. The override switch 70 is connected such that upon actuation thereof, pneumatic pressure is communicated directly from the source, bypassing the index valve 60, through the direction valve 64 and to the assist cylinder 56, causing the spool valve 40 to shift to a position so as to drive the motor 30 in a reverse direction, thereby resulting in reverse rotation of the ring 32, and thus, disengagement of the jaws 34. Both the override switch 70 and index switch 66 are conveniently located on the side of the frame 16, adjacent to the handle 26 (see FIG. 1).

Now turning to FIG. 4, wherein there is shown a schematic representation of the various components and associated circuitry, the operation of the improved indexing mechanism will be further described. It should be first pointed out that the schematic represents the various valves in their respective positions at the termination of a make-up operation under conditions wherein the side opening of the ring 32 is aligned with the throat of the frame 16 (as evidenced by the engagement of the ring cam 66 with the plunger 62 of index valve 60), but with the jaws 34 being engaged with the pipe 18. It should also be noted, at this time, that the clamping mechanism (not shown) of the back-up tong 12 is still in engagement with the lower pipe with the cylinder 15 in its retracted position. In such retracted cylinder position, the direction valve 64 is set in its make-up state. It should further be noted that the pneumatic inlet line 72 is under pressure; however, pressure is relieved from the system by venting to the atmosphere through passageways 74, 76 of the respective override and index switches 70 and 65.

Thus, under such above-state conditions, the first task to be performed is to disengage the clamping mechanism from the lower pipe. This is accomplished by moving the positioner valve 68 such that pneumatic pressure from the source inlet line 72 is communicated via line 78, passageway 80, line 82, to line 84, connected to the lower portion of cylinder 15 for actuation thereof whereby the clamping mechanism is retracted from the lower pipe. The exhaust pressure from the extension of cylinder 15 is vented to the atmosphere via line 86, 88 and passageway 90. The pressure in line 82 also serves to move the direction valve 64, thus setting the same in its second state, the reverse position from what is shown.

Once the back-up tong clamping mechanism has been retracted from the lower pipe, the override switch 70 is actuated, since in this case (as stated in the above conditions) the jaws 34 are engaged on the drill pipe 18 and the plunger 72 is in engagement with the cam 66 of the rotor 32. Upon actuation of the override switch 70, penumatic pressure from the source line 72, is communicated via line 92, passageway 94, line 96, shuttle valve 98, line 100, 100, passageway 102 of direction valve 64, line 104, exhaust valve 106, line 108 to the lower portion of the assist cylinder 56 wherein its piston rod end 58 is retracted and exhaust pressure is vented to the atmosphere through line 110 and exhaust valve 112. The retraction of the piston rod end 58 of assist cylinder 56 causes, through the linkage represented by the dashed line, the spool valve 40 to shift to a position wherein the motor 30 and therewith the ring 32 are rotated in a direction opposite to which they have previously been rotated. Thus, the reverse rotation of the ring 32 and the cam 66 therewith, moves the cam 66 out of engagement with the plunger 62 of index valve 60 such that the index switch 65 can now be actuated to thereby automatically align the side opening of the ring 32 with the throat of the frame 16.

Now, when the index switch is actuated, penumatic pressure is communicated from the source line 72, through passageway 114 and line 116 to the right side of the index valve 60, causing the plunger 62 to move left to its contacting position. With the index valve 60, in such contacting position, pressure from inlet line 72 is communicated via line 118, passageway 120, line 122, shuttle 98, line 100, passageway 102 of direction valve 64, line 104, exhaust valve 106, line 108 to the lower side of assist cylinder 56 wherein, as described above, the ring 32 is rotated in a reverse direction, whereupon the cam 66 comes into engagement with the plunger 62 of index valve 60, causing the same to move to its non-contacting position and thus stoppage of the motor 30 and therewith the rotation of ring 32 in its predetermined aligned position. Without going into further detail, it can be said that the improved indexing mechanism functions similarly wherein a break-out operation has been terminated and the ring 32 and the jaws therewith must be rotated again in a direction opposite form which it has been previously rotated so as to make the necessary alignment of the side opening with the throat. The reverse operation can easily be understood by those skilled in the art from the schematic representation set forth in FIG. 4 in conjunction with the foregoing description.

It is thought that the invention and many of its attendant advantages will be understood from the foregoing description and it will be apparent that various changes may be made in form, construction and arrangement of the components of the improved indexing mechanism without departing from the spirit and the scope of the invention or sacrificing all of its material advantages, the form hereinbefore described being merely a preferred or exemplary embodiment thereof.

Having thus described the invention, what is claimed is:

1. In a drilling apparatus for use in making-up and breaking-out of a drill string or the like by respectively connecting and disconnecting an upper pipe with a lower pipe having an open-head power tong including a frame having a central opening and a throat leading to said central opening from outside said frame, a ring having a side opening and rotatably mounted on said frame within said central opening, pipe engaging jaws mounted on said ring for movement into and out of said central opening to respectively engage and disengage a pipe disposed within said central opening, said ring when rotatably moved in a first direction causes said jaws to engage a pipe and rotate same in a make-up operation and when rotatably moved in a second opposite direction causes said jaws to engage and rotate a pipe in a break-out operation, said jaws when engaged with said pipe and rotated with said ring in one of said first and second directions being operably to disengage from said pipe upon thereafter being rotated with said ring in the other of said first and second directions, and hydraulic means including a hydraulic motor for rotatably driving said ring in said first and second directions, a source of hydraulic fluid pressure and a hydraulic control valve selectively moveable between first and second positions for directing fluid to said motor to respectively rotate said ring in respective first and second directions and moveable to a third position for obstructing the flow of fluid to said motor to stop same, an improved indexing mechanism for automatically aligning said throat of said frame with the side opening of said ring to facilitate lateral movement of pipe into and out of said central opening, said improved indexing mechanism comprising:

(a) a source of pneumatic pressure;

(b) a pneumatic index valve moveable between open and closed positions and having a plunger moveable between corresponding ring contacting and ring non-contacting positions, said plunger being moved to its ring contacting position when said index valve is moved to its open position and said index valve being moved to its closed position when said plunger is moved to its non-contacting ring position;

(c) a switch actuable to a first position for providing communication of pneumatic pressure from said source to said index valve which causes said index valve to be moved to its open position, said switch actuable to a second position for relieving said penumatic pressure on said index valve;

(d) a penumatic direction valve moveable between first and second states, said direction valve being set in its first state when said ring moves in its first direction and being set in its second state when said ring moves in its second direction;

(e) a pneumatic assist cylinder in communication with said index valve through said direction valve and is moveable between first, second, and third positions, said assist cylinder moveable to one of its first or second positions in response to penumatic pressure communicated from said index valve which, in turn, causes said hydrauulic control valve to move to one of its corresponding first or second positions, said assist cylinder also being moveable to a third position in response to relief of said pressure from said index valve which in turn causes said hydraulic control valve to move to its corresponding third position;

(f) said pneumatic direction valve, when set in its first state and upon actuation of said switch to its first position providing pneumatic pressure communication from said index valve to said assist cylinder valve so as to move the latter to its second position, causing said hydraulic control valve to move to its second position and, in turn, rotation of said ring in its second direction, said pneumatic direction valve, when set in its second state, and upon actuation of said switch to its first position, providing pneumatic pressure communication from said index valve to said assist cylinder so as to move the latter to its first position, causing said hydraulic control valve to move to its first position, and, in turn, rotation of said ring in its first direction; and (g) a cam on said ring and engageable with said plunger when the latter is at its ring contacting position to cause said plunger to move to its non-contacting position, said cam being located on said ring in reference to said side opening in the latter such that when said cam engages and moves said plunger from its contacting to its non-contacting position said side opening is aligned with said throat of said frame whereby after termination of either a make-up or break-out operation and stoppage of said motor, actuation of said switch to its first position causes said index mechanism to align said side opening of said ring with said throat of said frame by (1) moving said index valve to its open position and thereby said plunger to its ring contacting position, (2) pneumatically moving said assist cylinder to one of its first or second positions, and thereby said hydraulic control valve to one of its corresponding first or second positions, which causes said ring to rotate in a direction opposite to that in which it rotated during said respective terminated operation and thereby causes said pipe engaging jaws to disengage said pipe, said rotation of said ring being terminated and said alignment achieved when said cam engages said plunger moving the latter to its non-contacting ring position which, in turn, moves said index valve to its closed position thereby relieving pressure from said assist cylinder and allowing the latter and said hydraulic control valve to move to respective third positions wherein said hydraulic motor is stopped and rotation of said ring terminated.

2. The improved indexing mechanism as described in claim 1, further comprising: a second switch for overriding the operation of said index valve to move said ring so as to disengage said jaws from said pipe under conditions wherein at the termination of a previous make-up or break-out operation said jaws are engaged with said pipe and said side opening of said ring is aligned with said throat of said frame such that said plunger is held at its non-contacting position by said cam so as to prevent movement of said index valve to its open position upon actuation of said first switch to its first position, said second switch, to accomplish said override, being actuable to a first position for providing communication of penumatic pressure from said source to said assist cylinder through said direction valve to cause said assist cylinder to move to one of its first or second positions, as determined by said direction valve, causing said hydraulic control valve to move to a corresponding one of its first or second positions and, thus, rotation of said ring in a direction which causes disengagement of said jaws.

3. The apparatus as described in claim 1, further comprising: means for holding the lower pipe during a make-up or break-out operation of a drill string while the upper pipe is being rotated by said power tong, said holding means including clamping jaws and a pneumatic cylinder operably associated therewith to position the clamping jaws in a first location relative to said lower pipe during a make-up operation and in a second location relative to said lower pipe during a break-up operation, said improved indexing mechanism further comprising: a pneumatic positioner valve actuable to a first position for providing communication of pneumatic pressure from said source to said direction valve to set said direction valve in its first state such that said ring moves in its first direction and to a second position for providing communication of pneumatic pressure from said source to said direction valve to set said direction valve in its second state such that said ring moves in its second direction.

4. The improved indexing mechanism as described in claim 3, wherein said pneumatic cylinder provides communication of pneumatic pressure between said positioner valve and said direction valve such that when said positioner valve is actuated to its first position said cylinder positions said clamping jaws in said first location for a make-up operation and when said positioner valve is actuated to its second position said cylinder positions said clamping jaws in said second location for a break-out operation.

* * * * *

UNITED STATES PATENT OFFICE
CERTIFICATE OF CORRECTION

PATENT NO. : 4,170,908

DATED : October 16, 1979

INVENTOR(S) : John E. Peveto, Gregory D. Cathcart

It is certified that error appears in the above-identified patent and that said Letters Patent are hereby corrected as shown below:

Correct the spelling of the word "pneumatic" as it appears in:

Column 2, line 50
Column 3, line 11
Column 6, line 53
Column 7, line 3
Column 8, line 20
Column 8, line 21
Column 8, line 30
Column 9, line 31

Column 3, line 33 delete "accompnaying" and insert --accompanying--

Column 3, line 44 delete "diagramatic" and insert --diagrammatic--

Column 4, line 21 delete "4,055,621." and insert --4,005,621.--

Column 6, line 33 delete "above-state" and insert --above-stated--

Column 6, line 55 following "98, line" delete "100,"

Column 8, line 32 delete "hydrauulic" and insert --hydraulic--

Signed and Sealed this

*Twenty-second* Day of *January 1980*

[SEAL]

*Attest:*

SIDNEY A. DIAMOND

*Attesting Officer*

*Commissioner of Patents and Trademarks*